US011616299B2

(12) United States Patent
Gómez-Diaz et al.

(10) Patent No.: US 11,616,299 B2
(45) Date of Patent: Mar. 28, 2023

(54) NONRECIPROCAL REFLECTARRAY ANTENNAS BASED ON TIME-MODULATED UNIT-CELLS

(71) Applicant: The Regents of the University of California, Oakland, CA (US)

(72) Inventors: Juan Sebastián Gómez-Diaz, Davis, CA (US); Diego Correas Serrano, Phoenix, AZ (US); Alejandro Álvarez-Melcón, Cartagena (ES); Jiawei Zang, Beijing (CN)

(73) Assignee: The Regents of the University of California, Oakland, CA (US)

( * ) Notice: Subject to any disclaimer, the term of this patent is extended or adjusted under 35 U.S.C. 154(b) by 621 days.

(21) Appl. No.: 16/715,520

(22) Filed: Dec. 16, 2019

(65) Prior Publication Data

US 2021/0359409 A1 Nov. 18, 2021

Related U.S. Application Data

(60) Provisional application No. 62/781,984, filed on Dec. 19, 2018.

(51) Int. Cl.
*H01Q 3/46* (2006.01)
*H01Q 3/22* (2006.01)
(Continued)

(52) U.S. Cl.
CPC ..... *H01Q 3/46* (2013.01); *H01Q 1/288* (2013.01); *H01Q 1/38* (2013.01); *H01Q 3/22* (2013.01);
(Continued)

(58) Field of Classification Search
CPC ..... H01Q 3/46; H01Q 1/288; H01Q 3/22; H01Q 15/148; H01Q 21/065; H01Q 1/38;
(Continued)

(56) References Cited

PUBLICATIONS

Broadband single-layer reflectarray antenna for X-band applications, Bodur et al (Year: 2018).*
Firouzjaei, Ph.D Thesis UC Berkeley (Year: 2010).*

* cited by examiner

*Primary Examiner* — Arnold M Kinkead
(74) *Attorney, Agent, or Firm* — Park, Vaughan, Fleming & Dowler LLP

(57) ABSTRACT

The disclosed embodiments relate to the design of a system that implements a reflectarray antenna. The system includes a time-modulated metasurface, which is configured to act as a planar reflector for an electromagnetic wave that is radiated by a feeder into free space at an operation frequency $f_0$. The time-modulated metasurface includes time-modulated unit-cells that provide a nonlinear conversion between $f_0$ and another desired frequency $f_d$. The system also includes a phase-delay mechanism, which adjusts a phase delay by acting on a phase applied to a modulation frequency $f_m$ that modulates each unit-cell. The nonlinear conversion and the phase-delay mechanism operate collectively to facilitate angle-independent nonreciprocity by imposing different phase gradients during up-conversion and down-conversion processes, and by preventing generation of certain propagative harmonics due to total internal reflection.

52 Claims, 9 Drawing Sheets

(51) Int. Cl.

| | |
|---|---|
| ***H01Q 15/14*** | (2006.01) |
| ***H01Q 21/06*** | (2006.01) |
| ***H01Q 1/28*** | (2006.01) |
| ***H01Q 9/04*** | (2006.01) |
| ***H01Q 3/36*** | (2006.01) |
| ***H01Q 1/38*** | (2006.01) |

(52) U.S. Cl.
CPC ..... *H01Q 3/36* (2013.01); *H01Q 9/0457* (2013.01); *H01Q 15/148* (2013.01); *H01Q 21/065* (2013.01)

(58) Field of Classification Search
CPC ..... H01Q 3/36; H01Q 9/0457; H04B 1/00; H04B 7/00
USPC ..... 329/336; 343/778, 753, 754, 755, 777, 343/824
See application file for complete search history.

NONRECIPROCAL REFLECTARRAY ANTENNAS BASED ON TIME-MODULATED UNIT-CELLS

CROSS-REFERENCE TO RELATED APPLICATION

This application claims the benefit of U.S. Provisional Patent Application Ser. No. 62/781,984, entitled "Nonreciprocal Reflectarray Antennas Based on Time-Modulated Unit Cells," by inventors Juan Sebastian Gomez-Diaz, et al., filed on 19 Dec. 2018, the contents of which are incorporated by reference herein.

GOVERNMENT LICENSE RIGHTS

This invention was made with U.S. government support under grant number CAREER-1749177 awarded by the National Science Foundation (NSF). The U.S. government has certain rights in the invention.

BACKGROUND

Field

The disclosed embodiments generally relate to the design of reflective array (reflectarray) antennas. More specifically, the disclosed embodiments relate to the design of a reflectarray antenna that provides angle-independent nonreciprocity by imposing different phase gradients during transmission and reception processes, and by preventing generation of certain propagative harmonics due to their total internal reflection.

Related Art

Reflectarray antennas are tailored surfaces, which are composed of multiple driven elements that are able to reflect incoming electromagnetic waves to conform to high-gain radiation patterns. Because of their advantages over parabolic reflectors and phased-array antennas in terms of low-profile and simpler feeding, reflectarray antennas have gained significant attention in radar systems, as well as wireless and satellite communication systems.

Although reconfigurable reflectarray antennas based on various technologies, such as varactors, MEMS and liquid crystals, have been explored, they are usually lossy and unable to provide full control of a radiated beam in space. Furthermore, existing reflectarray antenna designs are subject to Lorenz reciprocity, thus providing identical response in transmission and reception, which limits their capabilities to deal with strong jamming or unwanted signals.

Hence, what is needed is a new reflectarray antenna design, which does not suffer from the above-described issues.

SUMMARY

The disclosed embodiments relate to the design of a system that implements a reflectarray antenna. The system includes a time-modulated metasurface, which is configured to act as a planar reflector for an electromagnetic wave that is radiated by a feeder into free space at an operation frequency $f_0$. The time-modulated metasurface includes time-modulated unit-cells that provide a nonlinear conversion between $f_0$ and another desired frequency $f_d$. The system also includes a phase-delay mechanism, which adjusts a phase delay by acting on a phase applied to a modulation frequency $f_m$ that modulates each unit-cell.

In some embodiments, the nonlinear conversion and the phase-delay mechanism facilitate angle-independent nonreciprocity by imposing different phase gradients during up-conversion (transmit mode) and down-conversion (receive mode) processes, and by preventing generation of certain propagative harmonics due to total internal reflection.

In some embodiments, the nonlinear conversion and the phase-delay mechanism facilitate transmitting a signal in one direction and receiving a signal from another direction.

In some embodiments, the nonlinear conversion and the phase-delay mechanism facilitate full control of shape and direction of a generated beam during the up-conversion process by imposing a configurable phase gradient.

In some embodiments, the modulation frequency $f_m$ for the time-modulated unit-cells is more than one order of magnitude smaller than the operation frequency $f_0$.

In some embodiments, each of the time-modulated unit-cells comprises a resonator with an incorporated time-modulated capacitor.

In some embodiments, the phase-delay mechanism controls the time-modulated capacitor in each of the time-modulated unit-cells by using a time-varying harmonic signal having frequency $\omega_m=2\pi f_m$ and phase $\varphi_m$.

In some embodiments, a capacitance value of the time-modulated capacitor varies with time as $C_p(t)=C_0[1+\Delta_m \cos(\omega_m t+\varphi_m)]$, wherein $C_0$ is an average capacitance value and $\Delta_m$ is a modulation index $0<\Delta_m<1$.

In some embodiments, each of the time-modulated unit-cells comprises: a patch antenna located on a top substrate, which acts as an interface element with free space; and a plurality of slots located on a bottom substrate. It also includes a short-circuited substrate-integrated waveguide (SIW), which hosts a varactor in a shunt configuration, wherein the varactor is located approximately $\lambda/4$ away from a short-circuit in the SIW, thereby implementing a tunable resonator, wherein during operation of the reflectarray antenna, incoming power from the patch antenna is coupled through the plurality of slots to the short-circuited SIW.

DETAILED DESCRIPTION

Figure 1B:
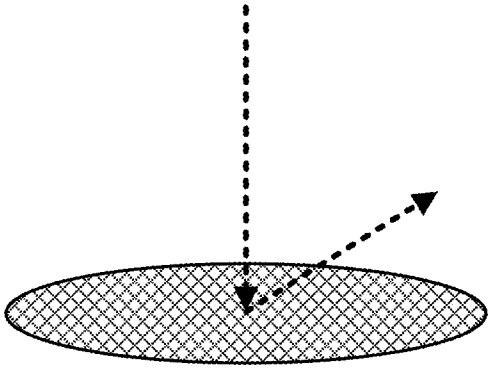
FIG. 1B illustrates how the nonreciprocal gradient metasurface in FIG. 1A receives and reflects a transmitted signal in accordance with the disclosed embodiments.

The following description is presented to enable any person skilled in the art to make and use the present embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present embodiments. Thus, the present embodiments are not limited to the embodiments shown, but are to be accorded the widest scope consistent with the principles and features disclosed herein.

The data structures and code described in this detailed description are typically stored on a computer-readable storage medium, which may be any device or medium that can store code and/or data for use by a computer system. The computer-readable storage medium includes, but is not limited to, volatile memory, non-volatile memory, magnetic and optical storage devices such as disk drives, magnetic tape, CDs (compact discs), DVDs (digital versatile discs or digital video discs), or other media capable of storing computer-readable media now known or later developed.

The methods and processes described in the detailed description section can be embodied as code and/or data, which can be stored in a computer-readable storage medium as described above. When a computer system reads and executes the code and/or data stored on the computer-readable storage medium, the computer system performs the methods and processes embodied as data structures and code and stored within the computer-readable storage medium. Furthermore, the methods and processes described below can be included in hardware modules. For example, the hardware modules can include, but are not limited to, application-specific integrated circuit (ASIC) chips, field-programmable gate arrays (FPGAs), and other programmable-logic devices now known or later developed. When the hardware modules are activated, the hardware modules perform the methods and processes included within the hardware modules.

Overview

The disclosed embodiments provide a reflectarray antenna that exhibits nonreciprocal characteristics based on time-modulated gradient metasurfaces. The primary building block of these surfaces is a subwavelength unit-cell whose reflection coefficient oscillates at low frequency. The associated time-modulation scheme facilitates tailoring the phase and amplitude of any desired nonlinear harmonic and determines the behavior of all other emerging fields. By appropriately adjusting the phase-delay applied to the modulation of each unit-cell, the disclosed embodiments realize time-modulated gradient metasurfaces that provide efficient conversion between two desired frequencies and enable nonreciprocity by: (i) imposing drastically different phase-gradients during the up/down conversion processes; and (ii) preventing the generation of certain propagative harmonics due to their total internal reflection. This new reflectarray design facilitates a number of useful functionalities, including beam-steering and focusing, while exhibiting strong and angle-independent nonreciprocal responses.

Gradient Metasurfaces

Gradient metasurfaces have enabled the control of electromagnetic waves in ways unreachable with conventional materials, giving rise to arbitrary wavefront shaping in both near- and far-fields. These surfaces are constructed using spatially varying subwavelength-resonant elements that impart inhomogeneous transverse momentum to the incoming waves and permits them to manipulate the amplitude, phase, and polarization of the scattered fields. In addition, the development of Huygens-based structures composed of unit-cells that combine magnetic and electric responses has overcome the low conversion efficiency challenges found in early designs. As a result, gradient metasurfaces have triggered the pursuit of exciting devices such as invisibility cloaks, flat lenses, absorbers, or polarization-dependent light splitters, greatly extending the responses provided by reflectarray antennas and frequency-selective surfaces at micrometer and millimeter wavelengths and even paving the way toward the realm of nonlinear optics to tailor the generated wavefronts at will.

Adding "temporal modulation" to gradient metasurfaces can further enrich their functionalities and enable more ambitious applications. For instance, it has been shown that spatiotemporally modulating the surface-impedance of an ultrathin layer permits overcoming geometrical symmetry constraints by inducing space-time photonic transitions that enable nonreciprocal beam-scanning. In fact, simultaneously imposing space- and time-gradient phase discontinuities at the interface between two media leads to a more general form of classical Snell's relations not bounded by Lorentz reciprocity. Very recently, the concept of time-modulated Huygens metasurfaces has been put forward and demonstrated at microwaves. By independently time-modulating the electric and magnetic dipoles that compose each meta-atom, this approach enables dynamic control of the conversion efficiency, shape, and direction of the nonlinear harmonics generated by the metasurface upon simple plane-wave illumination. The arguably major challenge faced by this platform is the relatively complicated time-varying waveforms that need to be applied to the tunable elements of each cell to enforce an adequate overlap between electric and magnetic contributions. Similar time-modulated metasurfaces have also been explored considering graphene-wrapped silicon microwires as unit-cells. It has theoretically been shown that controlling the signals that modulate the conductivity of each graphene tube permits manipulation of the wavefront and amplitude of the generated harmonics. It should also be noted that space-time coding has recently been applied to develop digital metasurfaces able to tailor electromagnetic waves in space and frequency. Such surfaces have demonstrated beam-scanning and shaping of nonlinear harmonic frequencies with dynamic control through a field-programmable gate array (FPGA). In a related context, magnetless approaches to breaking reciprocity, mostly through spatiotemporal modulation and nonlinearities, have recently received significant attention and have led to a wide variety of devices in acoustics and electromagnetics, such as circulators and isolators.

Figure 1C:
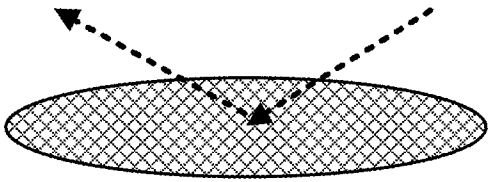
FIG. 1C illustrates how the nonreciprocal gradient metasurface in FIG. 1A reflects a received signal in accordance with the disclosed embodiments.

The disclosed embodiments facilitate "nonreciprocal wavefront engineering" by appropriately modulating the reflection coefficient of the unit-cells that compose a metasurface. This is pictorially illustrated in FIG. 1A by considering a plane wave oscillating at a frequency $f_0$ that impinges onto a time-modulated metasurface. As is illustrated in FIG. 1B, upon reflection, the structure efficiently up-converts most energy into the first nonlinear harmonic (or intermodulation product) at $f_0+f_m$, $f_m$ being the modulation frequency, shapes the generated beam, and steers it toward a desired direction. However, a wave coming toward the metasurface from that direction at $f_0+f_m$ as in FIG. 1C simply undergoes specular reflection. Strong nonreciprocity arises because the structure is unable to conform any beam at $f_0$. To better understand the operation principle and fundamental building block of this platform, it can be theoretically and experimentally demonstrated at microwave frequencies that modulating the reflection coefficient of a unit-cell in a periodic environment facilitates freely tailoring the phase and amplitude of the nonlinear harmonic fields, enabling highly efficient conversion between a pair of desired frequencies. This approach employs simple phase-delayed low-frequency tones as biasing signals and avoids the complex modulation schemes required in time-modulated Huygens metasurfaces. Our proposed unit-cell operates at microwaves in the X band and elegantly separates the free-space incoming waves from biasing signals, which flows across the ground of the device through simple coplanar waveguides. It is then possible to show that nonreciprocal responses over 13 dB can be achieved by using such unit-cells, modulated with adequate phase-delayed tones, to load and terminate a rectangular waveguide. Next, the physical mechanisms that govern nonreciprocity in time-modulated metasurfaces are unveiled, namely (i) the drastically different phase profiles imposed by time-modulated metasurfaces to waves oscillating at different frequencies; and (ii) a total internal reflection phenomenon that prevents the radiation of certain harmonic signals. The capabilities and broad reach of the proposed paradigm can be illustrated by designing and analyzing various time-modulated metasurfaces able to efficiently up-convert incoming waves to the first harmonic frequency ($f_0 \rightarrow f_0+f_m$) and realize functionalities such as beam-steering and focusing. In all cases, the metasurfaces are unable to shape any beam at the fundamental frequency ($f_0+f_m \rightarrow f_0$) during reception and exhibit angle-independent nonreciprocal responses over 20 dB. This unprecedented nonreciprocal performance goes well beyond the current state of the art, in which time-modulated techniques provide angle-dependent nonreciprocal harmonic generation and filtering. The disclosure then discusses the major opportunities and challenges faced by nonreciprocal time-modulated metasurfaces, including the development of sophisticated unit-cells and tunable phase-controlled low-frequency feeding networks. Such networks will empower time-modulated surfaces to dynamically implement arbitrary wavefronts, combining exciting applications, such as cloaking, camouflage, polarization-dependent routing, or near-field focusing with very large isolation. The proposed platform can be applied to realize tailored, nonreciprocal solutions at RF, terahertz, infrared, and optics provided that tunable components that can be modulated with low-frequency signals—such as varactors and high-quality 2D or optomechanical materials—are available. Similar concepts may be extended to enable strong nonreciprocal responses in other fields such as mechanics and thermodynamics.

Theory of Nonreciprocal Time-Modulated Gradient Metasurfaces

Figure 1A:
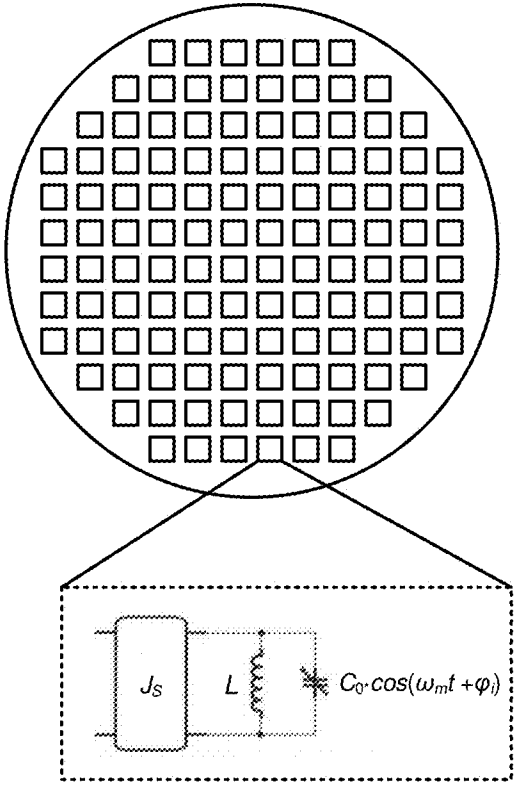
FIG. 1A illustrates a nonreciprocal gradient metasurface comprised of unit-cells in accordance with the disclosed embodiments.

Consider an infinite two-dimensional array of identical unit-cells that operate in reflection and resonate at $\omega_0=2\pi f_0$. Each cell is tunable and thus can be characterized using a resonator composed of an inductor and a varactor that provides a tunable capacitance through a biasing voltage. The coupling between the resonator and free space can be modeled using an admittance inverter, as shown at the bottom of FIG. 1A. In this form, the proposed cell could serve as a building block for reconfigurable gradient metasurfaces or reflectarray antennas, as previously proposed in the literature. Now apply a time-varying modulating signal of frequency ($\omega_m=2\pi f_m$) and phase ($\varphi_m$) to simultaneously control the varactor of all cells. Then, the capacitance $C_i$ of each resonator 'i' will vary with time according to $$C_i(t)=C_0[1+\Delta_m \cos(\omega_m t+\omega_m)], \tag{1}$$

where $C_0$ is the average capacitance value and $\Delta_m$ is the modulation index ($0<\Delta_m<1$) controlled through the power of the modulating signal. The reflection coefficient of this time-modulated surface can be expressed as $$R'(\omega_0+k\omega_m)=\sum_{n=-\infty}^{\infty} R_{(n,k)}e^{jn\omega_m t} \approx R_{(k,k)}+R_{(k+1,k)}e^{j\omega_m t}+R_{(k-1,k)}e^{-j\omega_m t}, \tag{2}$$

where $R_{(n,k)}=b(\omega_0+n\omega_m)/a(\omega_0+k\omega_m)$ is an inter-harmonic reflection coefficient that relates the fields of the incoming wave '$a(\omega_0+k\omega_m)$' oscillating at frequency $\omega_0+k\omega_m$ and the generated harmonic '$b(\omega_0+n\omega_m)$' with frequency $\omega_0+n\omega_m$ (n, k ∈ □). It should be emphasized that up- and down-conversion processes in time-modulated resonant unit-cells, for instance between different nonlinear harmonics n and k, are not identical, either in phase or amplitude, which entails an intrinsic nonreciprocal behavior. Analyzing the time-modulated cell, the inter-harmonic reflection coefficient between two specific harmonics can be derived as $$R_{(n,k)} \propto |M_{(n,k)}|\frac{\Delta_m}{2}e^{j(n-k)\varphi_m}, \tag{3}$$

where $M(n,k)\neq M(k,n)$. Assuming a modulation frequency significantly smaller than the operation frequency (i.e., $\omega_m \ll \omega_0$), it can easily be shown that the amplitudes for up- and down-conversion processes are similar (i.e., $|R_{(n,k)}|\approx|R_{(k,n)}|$). More interestingly, Eq. (3) reveals that the phase of the generated nonlinear harmonics is determined by the phase $\varphi_m$ introduced in the modulation signal, being positive (negative) for up (down) conversion. As a result, it is possible to control and manipulate the phase shift of the harmonics (thus tailoring their direction and shape) with the phase of an auxiliary, low-frequency modulating signal acting on the capacitor of each resonator. Note that similar behavior of the reflection coefficient has very recently been found in specific configurations, namely modulating both electrical and magnetic dipoles of meta-atoms in Huygens metasurfaces or the surface admittance of subwavelength elements in graphene-wrapped tubes. Here, it is demonstrated that such response can be obtained by simply modulating the capacitance of the resonant unit-cells that compose any metasurface.

Consider now the case of a 1D time-modulated gradient metasurface characterized by an inter-harmonic reflection coefficient $R_{(n,k)}(x) \propto e^{j(n-k)\varphi m(x)}$. In this expression, (x) denotes the smooth evolution of the cells' modulation signal phases versus the metasurface position along the x-axis. Assuming that a plane wave impinges at an angle $\theta_i$ relative to the direction normal to the metasurface, the generalized Snell's law for reflected waves can be expanded to $$k_n^{(r)}-k_k^{(i)}=\frac{d\varphi[R_{(n,k)}(x)]}{dx}, \tag{4}$$

where $k_k^{(i)}=k_k \sin(\theta_i)$ and $k_n^{(r)}=k_n \sin(\theta_r)$ are the in-plane wave vector components of the incident and reflected waves, respectively, $$k_n=\frac{\omega_0+nw_m}{c}$$

and $$k_k=\frac{\omega_0+k\omega_m}{c}$$

are the free-pace wavenumbers, and $$\frac{d\varphi[R_{(n,k)}(x)]}{dx}=(n-k)\frac{d\varphi_m(x)}{dx}$$

is the additional in-plane wave number imposed to the nth harmonic generated by the time-modulated surface. The importance of Eq. (4) is threefold. First, it shows that the sign of the phase gradient is different for up (positive) and down (negative) conversion processes. This subtle difference has very important implications for nonreciprocal wavefront engineering. For instance, it permits tailoring the phase profile exhibited by time-modulated metasurfaces at a given frequency. As a result, the structure will be able to convert an incoming plane wave into a harmonic beam (n→k) with tailored shape and direction. However, in the dual case (k→n), the metasurface will exhibit a phase profile that is exactly the negative of the previous one. In such a profile, the phase difference between two arbitrary unit-cells changes from positive to negative, which prevents any meaningful beam-shaping. Furthermore, and as described in detail below, it is possible to impede the generation of propagative harmonic beams by enforcing a total internal reflection process that leads to evanescent waves at the metasurface interface. Second, Eq. (4) explicitly shows that the wavenumbers of plane waves oscillating at different frequencies are involved in the reflection process, and therefore they should be considered in the design process. And third, it also confirms that time-modulated metasurfaces do not provide any phase-gradient when the frequencies of the incident and reflected waves are the same (i.e., n=k). In this case, the usual Snell's law of reflection is retrieved. These properties are in clear contrast to the ones of common linear, gradient metasurfaces, which exhibit a fixed phase profile imprinted in their subwavelength resonators. Despite their physical insight, it should be noted that the generalized Snell's laws rely on a wave approximation corresponding to geometric optics that works well to shape beams in the far-field. The synthesis of arbitrary wavefronts, especially in the near-field, requires more rigorous, full-wave approaches.

Figure 2B:
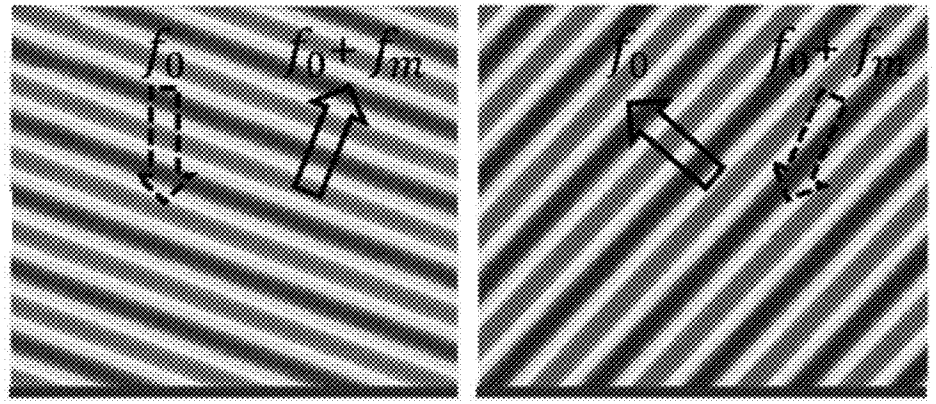
FIG. 2B illustrates a distribution of a z-component of an electric field scattered by the metasurface in accordance with the disclosed embodiments.
Figure 2C:
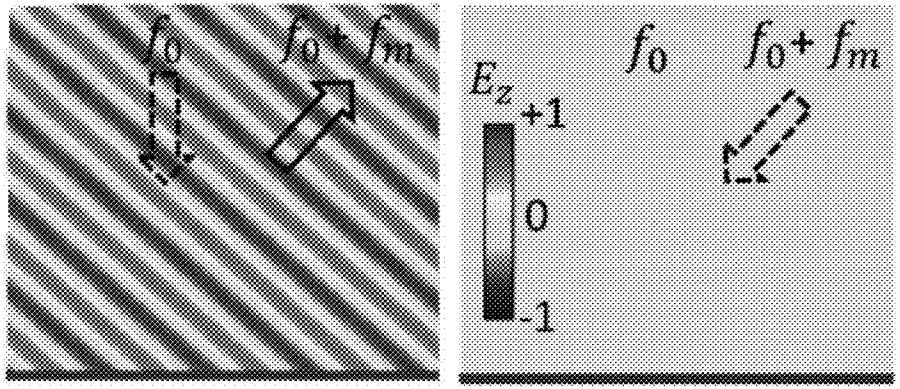
FIG. 2C illustrates a distribution of a z-component of an electric field scattered by another configuration of the metasurface in accordance with the disclosed embodiments.
Figure 2A:
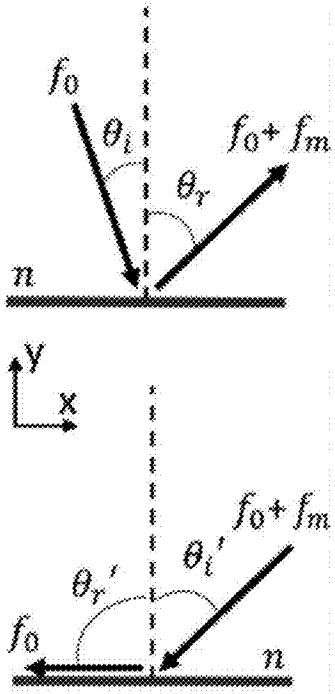
FIG. 2A illustrates wave reflections during up-conversion and down-conversion operations in accordance with the disclosed embodiments.

The simplest and probably most representative example of nonreciprocal wavefront engineering with time-modulated metasurfaces, illustrated in FIG. 2A, consists of converting a plane wave oscillating at $f_0$ and coming from an angle $\theta_i$ into a beam at $f_0+f_m$ and steering it toward an angle $\theta_r$ in free-space. In the dual case, a plane wave oscillating at $f_0+f_m$ that impinges onto the metasurface will not generate any wave-scattering or beam-shaping at $f_0$, virtually achieving infinite isolation. Such response can be obtained by (i) achieving efficient frequency conversion between $f_0$ and the nonlinear harmonic at $f_0+f_m$ while strongly limiting the energy coupled to any other intermodulation frequency, as described below; and (ii) synthesizing the phase profile of the signals that modulate the unit-cells composing the metasurface as $$\frac{d\varphi[R_{(1,0)}(x)]}{dx} = \frac{2\pi}{\Lambda} = k_1\sin(\theta_r) - k_0\sin(\theta_i),$$

where $\Lambda$ is the distance along the x-axis of the metasurface where the phase applied to the modulating signals has changed a total of $2\pi$ radians. Numerical simulations depicted in FIG. 2B (left panel) showcase this scenario and confirm that the imposed time-modulation shapes the harmonic wave and steers it toward a desired angle. At the fundamental frequency, the beam simply undergoes specular reflection because the metasurface does not impose any additional wavenumber to the reflected waves, i.e., $$\frac{d\varphi[R_{(0,0)}(x)]}{dx} = 0.$$

For the n=−1 harmonic, the time-modulated surface imparts a phase-gradient $$\frac{d\varphi[R_{(-1,0)(x)}]}{dx} = -\frac{d\varphi[R_{(1,0)}(x)]}{dx} = -\frac{2\pi}{\Lambda}$$

that directs it in the opposite direction to the one of the n=+1 harmonics. Let us now analyze the dual case (see the bottom of FIG. 2A): a plane wave oscillating at $f_0+f_m$ impinges onto the metasurface from the direction $\theta'_i=-\theta_r$. In most cases, as the one shown in FIG. 2B (right panel), the metasurface will generate fields oscillating at $f_0$ that will conform a propagative plane wave. Applying Eq. (3) allows us to retrieve the direction of the reflected beam as $$\sin(\theta'_r) = \sin(\theta_i) + \frac{2\pi}{\Lambda}\left(\frac{k_1+k_0}{k_1k_0}\right).$$

This equation clearly shows that the beam is further steered toward the backfire direction as the in-plane wavenumber imparted by the metasurface $$\left(\frac{2\pi}{\Lambda}\right)$$

increases. In the limiting case, illustrated in FIG. 2C, the beam generated at the fundamental frequency undergoes a total internal reflection and leads to surface waves that propagate along the metasurface and are thus unable to propagate back to the medium. Such a situation appears when the time-modulated metasurface imposes a wavenumber $$k_c = \frac{2\pi}{\Lambda_c} \geq (1-\sin(\theta_i))\frac{k_1k_0}{k_1+k_0}. \tag{5}$$

Given the analogue response provided by this wavenumber and the critical angle found at the interface between two dielectric media, $k_c$ is denoted as the critical wavenumber. It permits the engineering of time-modulated metasurfaces with very strong nonreciprocity by exploiting the interplay between propagative and surface waves during up/down conversion processes.

In addition to the phase control of the fields emerging from time-modulated metasurfaces, boosting and tailoring the conversion efficiency of the process is critical to enable practical applications. In many cases, it is necessary to prevent the generation of multiple harmonics and restrict the nonlinear processes to be very efficient in the conversion between two desired nonlinear harmonics n and k associated with the frequencies of interest. One approach may be designing Huygens metasurfaces and then independently modulating the electric and magnetic dipoles that compose each meta-atom. Even though this method enables great flexibility, it requires two nonlinear elements per unit-cell and relatively complicated time-waveforms to properly control the cell response. Besides, losses can be significant and may hinder the use of such structures in practice. Another option could be engineering structures that simultaneously resonate at two desired frequencies, as recently realized in nonlinear gradient metasurfaces aimed for second-harmonic generation. Unfortunately, such designs are challenging in time-modulated metasurfaces because (i) both tunable resonances should equally depend on the modulation signal; and (ii) the spectral separation between fundamental and harmonic signals is usually small.

Time-Modulated Unit-Cells

Figure 3A:
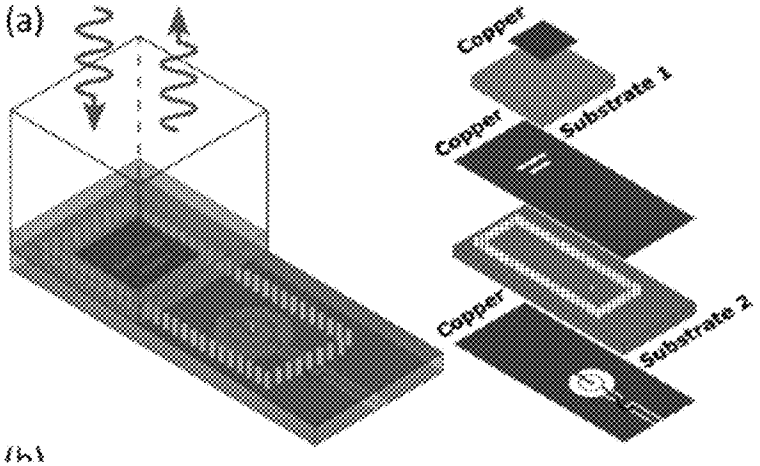
FIG. 3A illustrates an exemplary unit-cell in accordance with the disclosed embodiments.
Figure 3B:
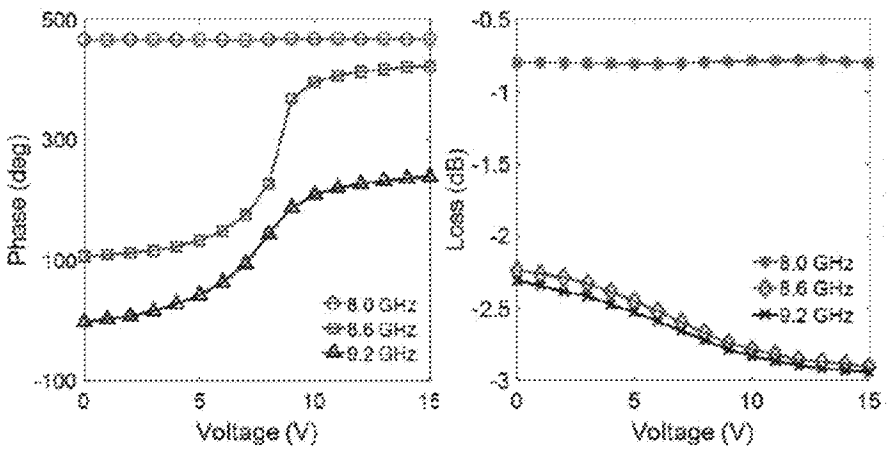
FIG. 3B presents graphs illustrating a measured phase and losses of the unit-cell reflection coefficient in accordance with the disclosed embodiments.
Figure 3C:
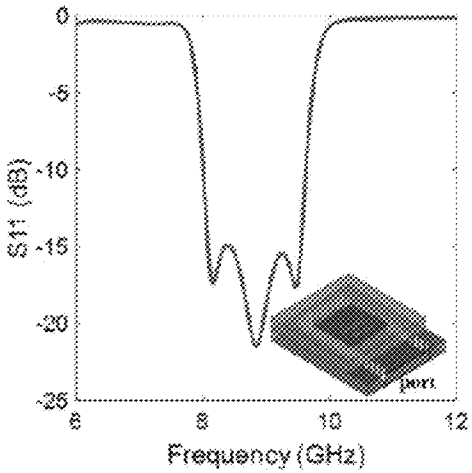
FIG. 3C presents a graph illustrating simulated scattering patterns of a unit-cell located in an infinite periodic environment in accordance with the disclosed embodiments.

This section introduces a new unit-cell operating at microwaves that allows to efficiently modulate its reflection coefficient. The structure is designed to provide very efficient frequency-conversion between the fundamental frequency and the first nonlinear harmonic while allowing full manipulation of the phase of the emerging fields by tuning the phase of the low-frequency modulating signal. The cell is composed of a resonant patch and several resonant slots coupled to a short-circuited substrate integrated waveguide (SIW) that hosts a varactor diode in shunt configuration, as illustrated in FIG. 3A. The resonant elements provide the coupling to free-space and implement the admittance inverter of the equivalent circuit shown at the bottom of FIG. 1A, wherein the capacitance value is $C_0*\cos(\omega_m t+\varphi_i)$. In addition, the varactor is located roughly $\lambda/2$ away from the SIW short-circuit to implement a tunable resonator. Physically, this lumped component is placed in the backside of the SIW through a via-hole and is biased using a coplanar waveguide. This scheme prevents unwanted interference between the incoming energy and the modulation signal. FIG. 3B shows the measured phase of the unit-cell reflection coefficient ($\varphi[R_{(0,0)}(\omega)]$) and loss versus the static biasing voltage of the varactor. Results confirm that, in the absence of time-modulation, the cell provides a phase range over 300° at several frequencies, thus assuring that it can host efficient frequency conversion processes. Besides, it confirms that the loss introduced by the cell is low, remaining below 3 dB in all cases. Numerical simulations shown in FIG. 3C reveal a relatively broadband (≈19%) coupling to free-space from the SIW line in the absence of the varactor. The resulting sharp transfer function, obtained after a proper adjustment of the couplings between the slots and the patch, helps in attenuating unwanted harmonics generated by the varactor.

Figure 4A:
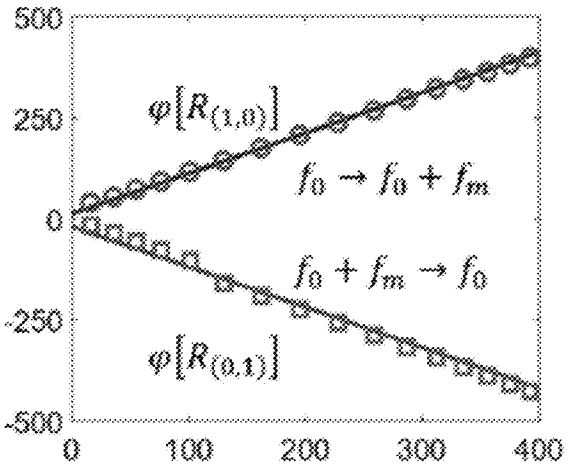
FIG. 4A presents a graph illustrating numerically simulated phases for inter-harmonic reflection coefficients versus the phase of the modulating signal in accordance with the disclosed embodiments.
Figure 4B:
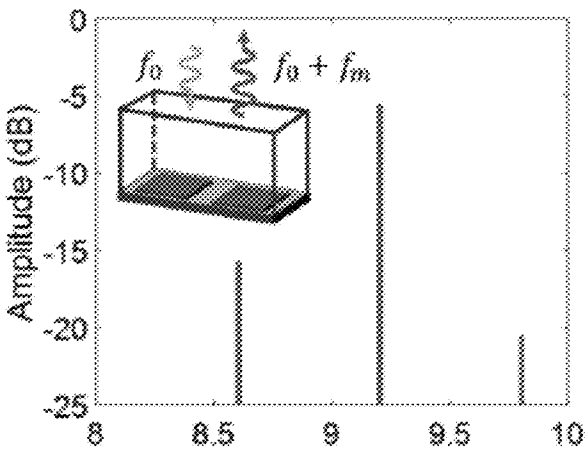
FIG. 4B presents a graph illustrating a measured amplitude for a reflected wave when the waveguide is excited at $f_0$=8.6 GHz in accordance with the disclosed embodiments.
Figure 4C:
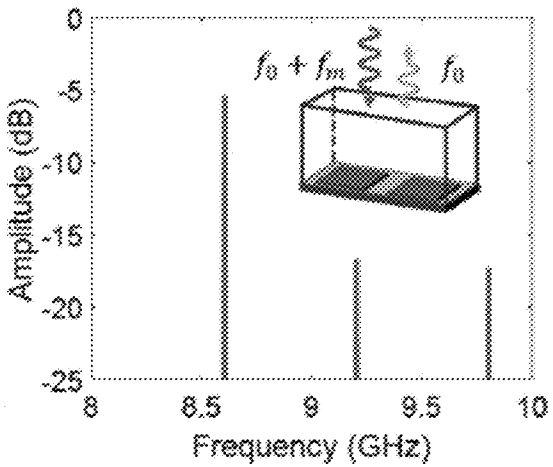
FIG. 4C presents a graph illustrating a measured amplitude for a reflected wave when the waveguide is excited at $f_0+f_m$=8.97 GHz in accordance with the disclosed embodiments.

In order to test the response of the unit-cell upon time-modulation in a controlled environment, it has been placed within an infinite waveguide simulator. This configuration has widely been employed in the fields of reflectarrays and phased-array antennas and exploits the fact that, under certain conditions, a common rectangular waveguide loaded with unit-cells exactly reproduces the behavior of a transverse electric (TE) plane wave propagating in free-space that impinges onto an infinite array of unit-cells with a given angle with respect to the direction normal to the structure. In our case, the required conditions are fulfilled by using two symmetric unit-cells with identical time-modulation. Specifically, a source is used to generate a low-frequency signal $f_m$=600 MHz and a phase-shifter to control its phase ($\varphi_m$). Note that the signal amplitude controls the modulation index $\Delta_m$. In addition, a directional coupler is employed to direct the microwave signal oscillating at $f_0$=8.6 GHz to the waveguide simulator and to couple the reflected signals to a spectrum or a vector network analyzer. FIG. 4A shows the measured phase of the inter-harmonic reflection coefficients $\varphi[R_{(1,0)}]$ and $\varphi[R_{(0,1)}]$ versus the phase of the modulating signal $\varphi_m$. Results show the linear dependence between the different phases and confirm the positive and negative slopes for the up-conversion (0→1) and down-conversion (1→0), respectively, experimentally demonstrating nonreciprocity in phase. The measured data also confirms that the proposed unit-cell can tailor the phase of the emerging fields over a wide range, which is crucial to enable beam-shaping functionalities. FIGS. 4B-4C show the measured amplitude of the signals generated by the cells when excited at the fundamental $f_0$ frequency and at the first harmonic $f_0+f_m$, respectively. Results show symmetrical conversion efficiencies over 10 dB for both up and down processes, with a total loss of 5 dB. Remarkably, the generation of unwanted harmonics has been significantly mitigated thanks to the sharp frequency-dependent coupling between the cell and free-space (see FIG. 3C). This study confirms that the proposed time-modulated unit-cell can simultaneously tailor the phase of the generated harmonics and provide very high conversion efficiency between two desired frequencies. The potential applications of this cell extend beyond the context of nonreciprocity explored here and include the development of gradient metasurfaces aimed at arbitrary wave-shaping and true-time delay configurations, which facilitate exploiting the large phase range that the cell provides, as well as more specific applications in the fields of reflectarray antennas and lenses.

Figure 5A:
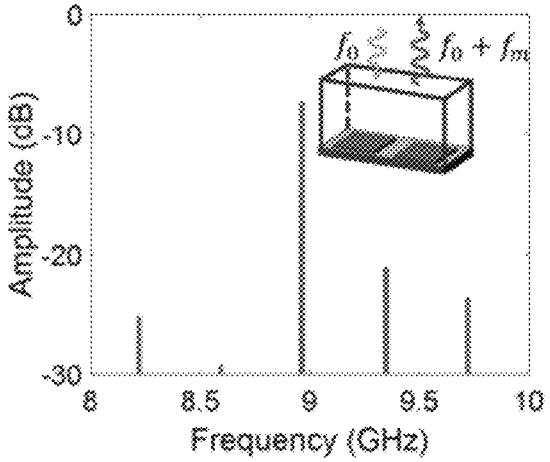
FIG. 5A presents a graph illustrating a measured amplitude for a reflected wave when the cells are biased with harmonic signals that oscillate at 370 MHz and exhibit a phase difference of $\varphi_d$=130° and when the waveguide is excited at $f_0$=8.6 GHz in accordance with the disclosed embodiments.
Figure 5B:
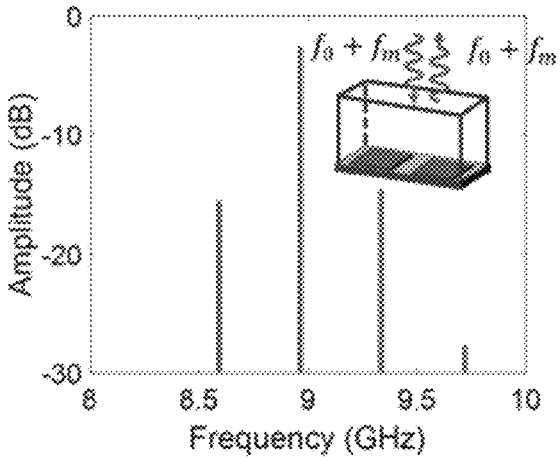
FIG. 5B presents a graph illustrating a measured amplitude for a reflected wave when the cells are biased with harmonic signals that oscillate at 370 MHz and exhibit a phase difference of $\varphi_d$=130° and when the waveguide is excited at $f_0+f_m$=8.97 GHz in accordance with the disclosed embodiments.

Aiming to investigate the ability of the proposed cells to impart phase-gradients through time-modulation, their electromagnetic response is studied within the waveguide simulator when the varactors are biased with modulating signals that oscillate at the same frequency $f_m$=370 MHz but exhibit different phases, $\varphi_{m1}$ and $\varphi_{m2}$. It should be noted that, in contrast to the previous example, this case does not directly correspond to an infinite array of unit-cells located in free-space but simply to a waveguide terminated with a time-modulated load. FIGS. 5A-5B show the measured amplitude of the reflected signals when the phase difference between the modulation signals is $\varphi_{md}=\varphi_{m1}-\varphi_{m2}$=130°. Exciting the time-modulated load through the waveguide at the fundamental frequency $f_0$=8.6 GHz efficiently up-converts (>20 dB) the incoming energy to the first harmonic $f_0+f_m$=8.97 GHz, whereas very little power is transferred to other harmonics, as shown in FIG. 5A. The first nonlinear harmonic becomes dominant, exhibiting over 13 dB more power than any other intermodulation product. The overall loss is 7.3 dB, which is 2.3 dB larger than the one provided by the cell in the absence of time-induced phase-gradients. In the dual case, depicted in FIG. 5B, the load is excited at $f_0+f_m$=8.97 GHz and most of the reflected power remains at this frequency without undergoing any frequency conversion. The phase-gradient imparted by the time-modulated load prevents any energy-scattering at $f_0$ (a phenomenon closely related to total internal reflection of the harmonics described above) and forces the energy to remain at the excitation frequency within the SIW line, whence it is subsequently radiated back toward the waveguide. Such mechanism decreases the influence of loss to 2.4 dB and forces the excitation frequency $f_0+f_m$ to become dominant, with over 13 dB more power than other harmonics. This example illustrates how phase-gradients imposed by time-modulated cells are useful to engineer and induce strong nonreciprocal responses.

Nonreciprocal Beam-Steering with Time-Modulated Metasurfaces

The proposed unit-cell can serve as a building block to construct time-modulated metasurfaces exhibiting exciting nonreciprocal responses. In the analysis/design process of such devices, assume that (i) each time-modulated unit-cell is within a perfect periodic environment, which allows taking into account the coupling between adjacent cells and higher order interactions (see FIGS. 4A-4C); and (ii) the variation of the modulation signal's phase profile $\varphi_m(x,y)$ applied to adjacent unit-cells is smooth. These assumptions are similar to the ones usually applied in the fields of gradient metasurfaces and reflectarray antennas and therefore permit us to borrow well-established analysis and design tools employed there. Note that such techniques are an approximation that works very well in practice and are systematically used to design many devices and antennas. More challenging, arbitrary wavefronts can be synthesized using full-wave approaches. In the following section, the measured response of the unit-cell is applied as is shown in FIGS. 4A-4C (both in phase and amplitude) to numerically design and investigate time-modulated metasurfaces able to provide nonreciprocal beam-steering and focusing.

Figure 6A:
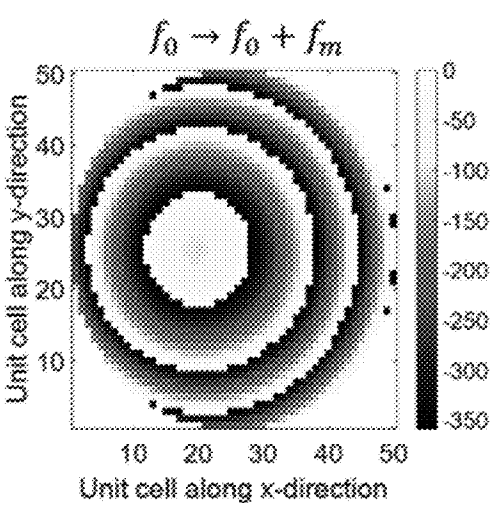
FIG. 6A illustrates a phase profile (in degrees) imparted by the time-modulated metasurface for the up-conversion process $f_0 \rightarrow f_0+f_m$ in accordance with the disclosed embodiments.
Figure 6B:
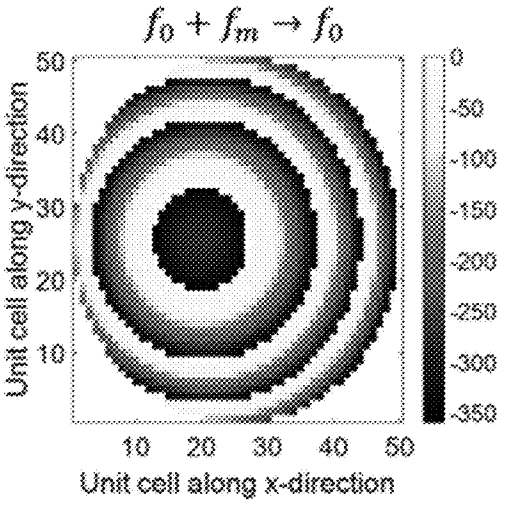
FIG. 6B illustrates a phase profile (in degrees) imparted by the time-modulated metasurface for the down-conversion process $f_m+f_0 \rightarrow f_0$ in accordance with the disclosed embodiments.
Figure 6C:
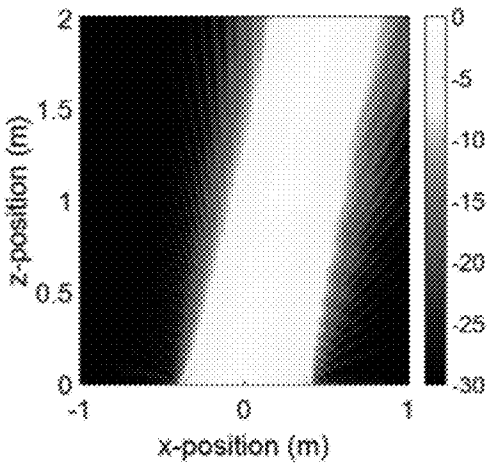
FIG. 6C illustrates normalized power density (dB) of waves oscillating at $f_0+f_m$ generated by the metasurface in accordance with the disclosed embodiments.
Figure 6D:
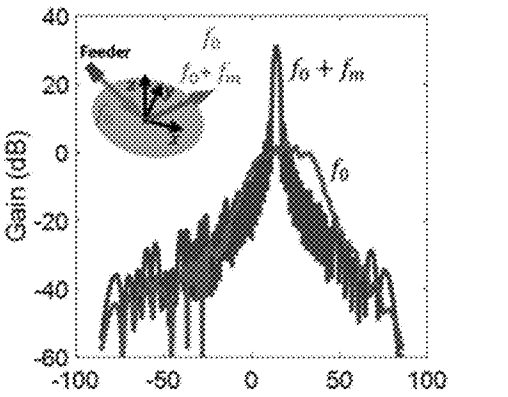
FIG. 6D illustrates an associated up-conversion radiation diagram in accordance with the disclosed embodiments.
Figure 6E:
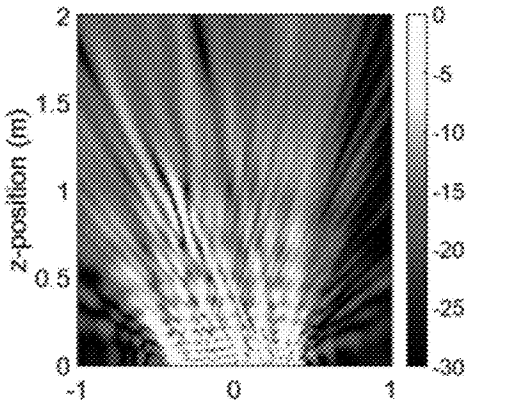
FIG. 6E illustrates normalized power for the down-conversion response in accordance with the disclosed embodiments.
Figure 6F:
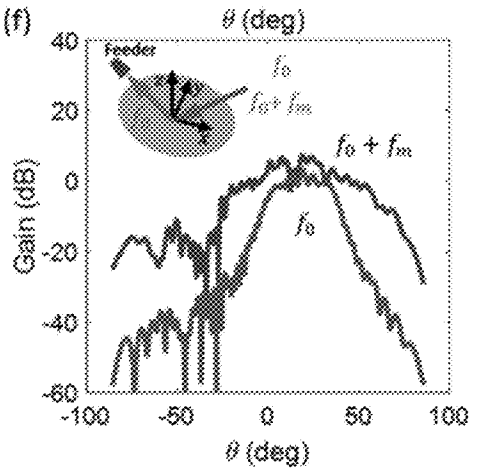
FIG. 6F illustrates a far-field distribution that, upon reflection on the time-modulated metasurface, focuses on the feeder at $f_0$ in accordance with the disclosed embodiments.
Figure 7A:
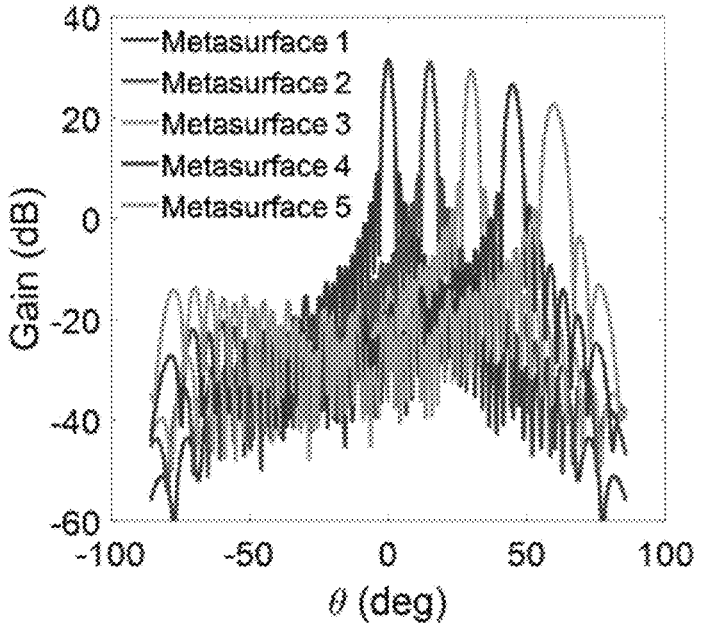
FIG. 7A illustrates gain for several time-modulated metasurfaces for a far-field distribution oscillating at $f_0+f_m$ shaped by the metasurfaces excited by the feeder at $f_0$ in accordance with the disclosed embodiments.
Figure 7B:
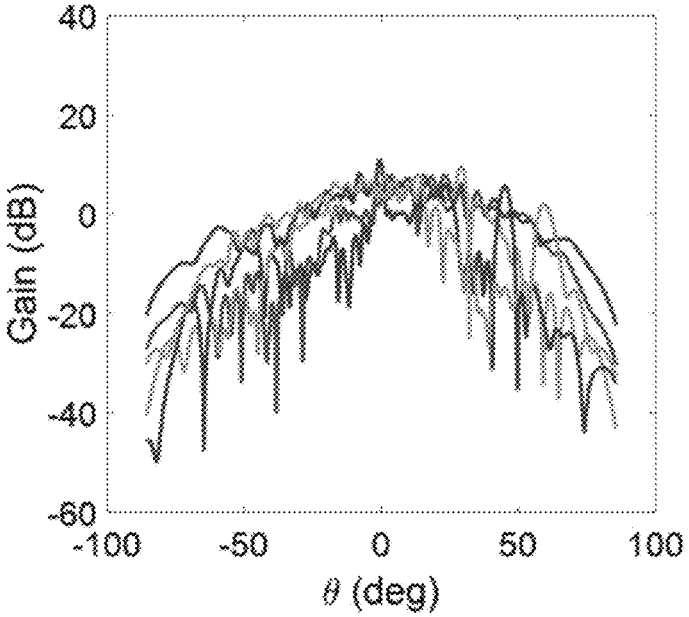
FIG. 7B illustrates gain for several time-modulated metasurfaces for a far-field distribution oscillating at $f_0+f_m$ that, upon reflection on the time-modulated metasurface, focuses on the feeder at $f_0$ in accordance with the disclosed embodiments.

As a first example, a time-modulated metasurface composed of 50×50 unit-cells is designed to shape a TE plane wave oscillating at $f_0+f_m$=9.2 GHz toward the direction $\theta_0$=14°, $\varphi_0$=0°. The separation distance between cells is 16.7 mm, which is below half wavelength at the design frequency. The surface is illuminated using an x-polarized horn antenna (modeled with a $\cos^q(\theta)$ function, with q=10) transmitting at $f_0$=8.6 GHz and located at the position $x_F$=−322 mm, $y_F$=0 mm, and $z_F$=838 mm with respect to the center of the surface. FIGS. 6A-6B show the phase profile imparted by the time-modulated surface for up ($f_0 \rightarrow f_0+f_m$) and down ($f_0+f_m \rightarrow f_0$) conversion processes, respectively. It is evident that they exhibit sharp differences. The phase profile for up-conversion has specifically been designed using the information from FIG. 4A to achieve the desired performance. In contrast, in the down-conversion process, each time-modulated unit-cell provides a negative phase-shift with respect to the up-conversion case that prevents any control over the generated beam. In addition, some cells may impart a momentum larger than the critical one, thus partially preventing energy-scattering at $f_0$. FIG. 6C illustrates the power density of the beam shaped by the metasurface at $f_0+f_m$ in the plane y=0, confirming that it is indeed directed toward the desired direction. The up-conversion diagram of the metasurface is depicted in FIG. 6D. Results show that a high gain beam (26.8 dB) has been obtained. The same panel plots the fields reflected at $f_0$. As discussed above, the time-modulated metasurface does not provide any extra phase to waves that remain at the same frequency as the coming ones, and therefore the structure simply behaves as a lossy specular reflector unable to shape the wavefront. Let us now examine the dual case: a plane wave oscillating at $f_0+f_m$ impinges on the metasurface from the direction $\theta_0=14°$, $\varphi_0=0°$. Upon reflection, the structure efficiently down-converts the waves to $f_0$ but, due to the negative phase profile that it imposes, is neither able to focus the energy into the feeder nor to conform any beam (see FIG. 6E). Note that a reciprocal surface would have focused the beam into the feeder. To determine the spatial distribution of plane waves oscillating at $f_0+f_m$ that after reflection on the surface would have been focused into the feeder at $f_0$, i.e., the down-conversion radiation diagram, the path followed by such waves is traced back. To do so, simply analyze the response of the metasurface operating in down-conversion (i.e., $f_0+f_m \rightarrow f_0$) when it is excited from the feeder at $f_0$. Once the radiation patterns for up- and down-conversion have been retrieved, the nonreciprocal behavior of the metasurface is obtained by analyzing the differences between both patterns. FIG. 6F depicts the down-conversion radiation diagram of the time-modulated surface. Results show that a spatially broad distribution of plane waves oscillating at $f_0+f_m$ simultaneously illuminating the metasurface is required to focus the energy (at $f_0$) on the feeder position. Such a response clearly indicates that the metasurface is unable to shape any beam during down-conversion processes. Instead, it incoherently distributes the generated power in space. Strikingly, even a simple piece of metal with identical size as the metasurface exhibits better beam-shaping capabilities. A comparison between FIGS. 6D and 6F unveils large nonreciprocity, over 20 dB. The reported nonreciprocity is robust, angle-independent, and is preserved in all beam-shaping scenarios due to the strong difference between the phase profile in up/down conversion processes. To show that this is indeed the case, time-modulated metasurfaces have been designed to direct the beam at $f_0+f_m$ toward different pointing angles, ranging from $\theta_0=0°$ to 70° (in steps of one degree) keeping in all cases $\varphi_0=0°$. Such responses can be achieved in practice on a single metasurface by adjusting the modulation phase profile (x,) applied to the biasing signals using a FPGA. Some of the up/down radiation diagrams of the metasurface designs are depicted in FIGS. 7A-7B. Our numerical results demonstrate again the inability of the surface to tailor any beam in the down-conversion process, leading in all cases to similarly uncollimated broad patterns. As consequence, the nonreciprocal strength of the surface is mostly determined by the maximum gain achieved in the up-conversion process.

Figure 8A:
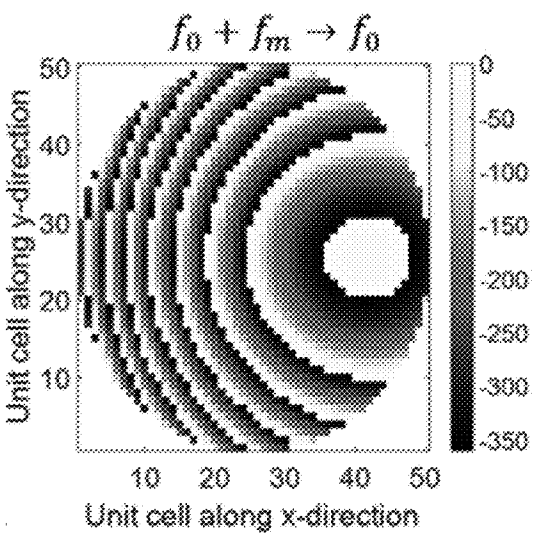
FIG. 8A illustrates a phase profile (in degrees) imparted by the time-modulated metasurface for a down-conversion process $f_m+f_0 \rightarrow f_0$ in accordance with the disclosed embodiments.
Figure 8B:
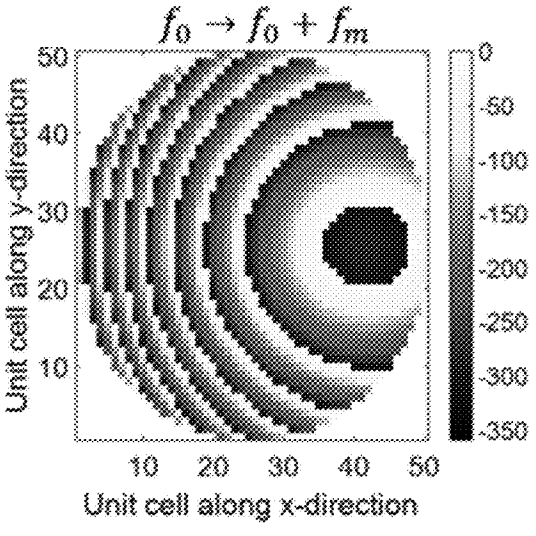
FIG. 8B illustrates a phase profile (in degrees) imparted by the time-modulated metasurface for an up-conversion process $f_0 \rightarrow f_0+f_m$ in accordance with the disclosed embodiments.
Figure 8C:
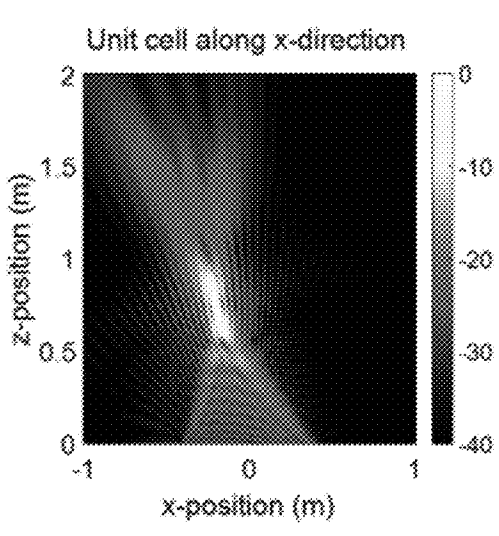
FIG. 8C illustrates normalized power density (dB) of the waves oscillating at $f_0$ generated by the metasurface in accordance with the disclosed embodiments.
Figure 8F:
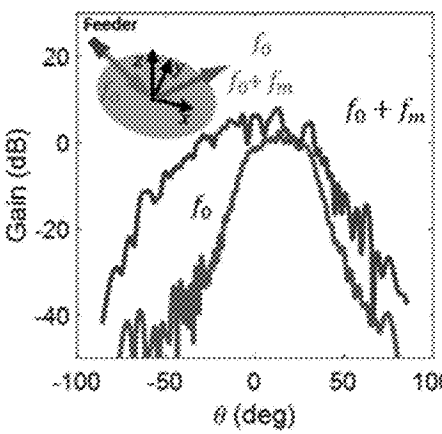
FIG. 8F illustrates an up-conversion radiation diagram in accordance with the disclosed embodiments.
Figure 8E:
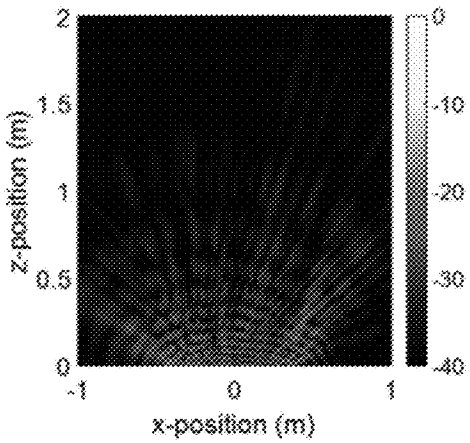
FIG. 8E illustrates a power density (dB) for waves oscillating at $f_0+f_m$ generated by the metasurface when excited by an isotropic emitter radiating at $f_0$ in accordance with the disclosed embodiments.
Figure 8D:
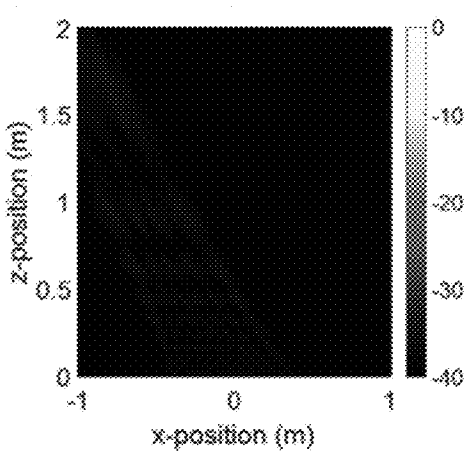
FIG. 8D illustrates normalized power density (dB) of the waves oscillating at $f_0+f_m$ generated by the metasurface in accordance with the disclosed embodiments.

As a second example, the phases of the signals that modulate the metasurface described above have been tailored to down-convert a TE plane wave coming from $\theta_0=30°$, $\varphi_0=0°$ with frequency $f_0+f_m$ to the n=−1 harmonic (i.e., $f_0$), and then focus it at $(x_F, y_F, z_F)=(-197, 0, 737)$ mm. FIGS. 8A-8B illustrate the phase profiles exhibited by the metasurface for the up- and down-conversion processes, respectively. The down-conversion phase profile has been specifically tailored to realize the desired functionality, whereas the up-conversion profile has been left as an afterthought. FIGS. 8C-8D show the normalized power density in the plane y=0 generated by the metasurface at $f_0$ and $f_0+f_m$, respectively. Results indicate that near-perfect focusing of the beam generated at $f_0$ has been achieved. On the contrary, the waves that remain at $f_0+f_m$ simply undergo specular reflection on the surface and thus are not focused. To investigate the nonreciprocal response of this time-modulated metasurface, it is excited with an isotropic emitter that is located at the focus position and radiates at $f_0$. FIG. 8E depicts the normalized power density at $f_0+f_m$ in the plane y=0, confirming that the surface is unable to collimate any beam. Instead, it incoherently distributes the generated energy. A reciprocal surface would have reflected a plane wave directed toward $\theta_0=+30°$, $\varphi_0=0°$. Finally, FIG. 8F shows the up-conversion radiation diagram of the metasurface, illustrating the inability of the surface to conform any beam.

This disclosure has outlined the foundation for nonreciprocal wavefront engineering using time-modulated metasurfaces through two specific examples. The core physics that govern these devices is quite general, and it is expected that a much wider range of nonreciprocal time-modulated metasurfaces exhibiting advanced functionalities, including polarization control and conversion, will be investigated and demonstrated in the near future. This task will require the development of refined full-wave approaches able to accurately design surfaces that provide nonreciprocal arbitrary wavefronts, especially in the very near field. Even though this work focuses on metasurfaces operating in reflection, the proposed platform is also perfectly suited to operate in transmission by simply time-modulating the transmission coefficient of the unit-cells. The two major challenges faced by this platform are related to the complexity of the required cells and tunable feeding networks. The former is undoubtedly the most critical aspect, since time-modulated cells should exhibit stringent responses in terms of low-loss, large and controlled tunability, as well as good conversion efficiency between two desired frequencies. It is expected that future time-modulated cells will significantly benefit from the vibrant ongoing activity in the fields of reconfigurable gradient metasurfaces and reflectarray/lens antennas. On the other hand, advanced concepts and designs from the well-established field of phased-array antennas can readily be translated to design low-frequency phase-agile feeding networks for the biasing signals. This vast landscape of possibilities combined with the exciting functionalities and applications enabled by time-modulated metasurfaces provide an exciting and promising future for this technology.

Process of Operation

Figure 9:
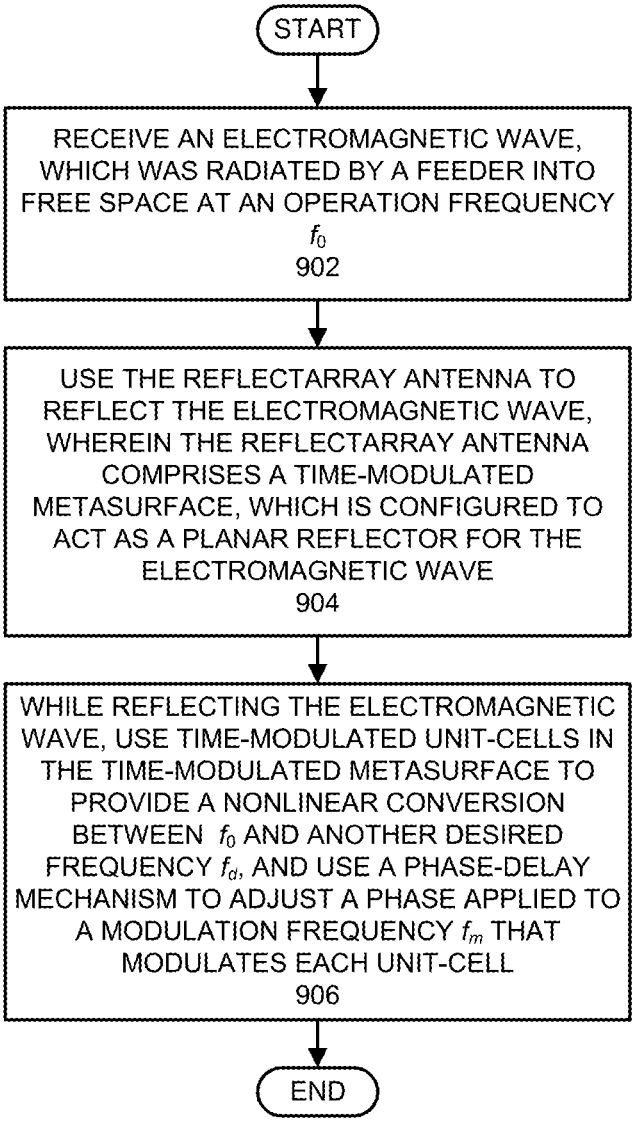
FIG. 9 presents a flow chart for the process of operating a reflectarray antenna system in accordance with the disclosed embodiments.

FIG. 9 presents a flow chart for the process of operating a reflectarray antenna system in accordance with the disclosed embodiments. During operation, the system receives an electromagnetic wave, which was radiated by a feeder into free space at an operation frequency $f_0$ (step 902). Next, the system uses the reflectarray antenna to reflect the electromagnetic wave, wherein the reflectarray antenna comprises a time-modulated metasurface, which is configured to act as a planar reflector for the electromagnetic wave (step 904). While reflecting the electromagnetic wave, use time-modulated unit-cells in the time-modulated metasurface to provide a nonlinear conversion between $f_0$ and another desired frequency $f_d$, and use a phase-delay mechanism to adjust a phase applied to a modulation frequency $f_m$ that modulates each unit-cell (step 906). Note that the nonlinear conversion and the phase-delay mechanism facilitate angle-independent nonreciprocity by imposing different phase gradients during up-conversion and down-conversion processes, and by preventing generation of certain propagative harmonics due to total internal reflection.

CONCLUSIONS

Time-modulated gradient metasurfaces form an ideal platform to realize nonreciprocal wavefront engineering across the electromagnetic spectrum. This platform combines the flexibility of gradient metasurfaces to control electromagnetic waves in unique and unprecedented ways with strong and angle-independent nonreciprocity. To realize such devices, it is possible to modulate the reflection coefficient of the unit-cells that compose the metasurface with phase-delayed low-frequency tones. It has been theoretically and experimentally shown that such modulation permits the manipulation of the phase and amplitude of one desired nonlinear harmonic while fixing the field distribution of the other harmonics. Specifically, a novel unit-cell is introduced, which operates at microwaves in the X band that provides efficient conversion between two desired frequencies and allows an effective modulation of its reflection coefficient. Nonreciprocal responses of around 13 dB have been measured by modulating these cells with an adequate temporal phase gradient and using them to load and terminate a waveguide. In a controlled periodic environment, the cells have been characterized based on time-modulation, and total control of the phase of the generated nonlinear harmonic in a nonreciprocal manner has been demonstrated through the phase of the biasing signal. Appropriately extending and manipulating such phase control over the cells that compose a metasurface has allowed us to engineer nonreciprocal responses in amplitude by (i) providing drastically different phase profiles in up/down conversion between two harmonics; and (ii) preventing the generation of certain harmonics by exploiting their potential total internal reflection. The reported nonreciprocity is strong, angle-independent, and preserved in any beam-shaping scenario. Even though the analysis shown here has been limited to functionalities like nonreciprocal beam-shaping and focusing, the versatility and far-reaching implications of this platform should be emphasized: it can in principle be employed to generate arbitrary wavefronts, enable near-field light matter interactions, and realize components such as antennas, invisibility cloaks, or absorbers while simultaneously providing large nonreciprocal behavior. This paradigm will lead to a new generation of nonreciprocal devices and surfaces with wide implications in communication and sensing systems as well as in optical networks and thermal management.

Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

The foregoing descriptions of embodiments have been presented for purposes of illustration and description only. They are not intended to be exhaustive or to limit the present description to the forms disclosed. Accordingly, many modifications and variations will be apparent to practitioners skilled in the art. Additionally, the above disclosure is not intended to limit the present description. The scope of the present description is defined by the appended claims.

What is claimed is:

1. A reflectarray antenna, comprising:

a time-modulated metasurface configured to act as a planar reflector for an electromagnetic wave, which is radiated by a feeder into free space at an operation frequency $f_0$, wherein:

the time-modulated metasurface includes time-modulated unit-cells that provide a nonlinear conversion between $f_0$ and another desired frequency $f_d$; and each of the time-modulated unit-cells comprises a resonator with an incorporated time-modulated capacitor; and a phase-delay mechanism, which adjusts a phase delay by acting on a phase applied to a modulation frequency $f_m$, that modulates each unit-cell.

2. The reflectarray antenna of claim 1, wherein the nonlinear conversion and the phase-delay mechanism facilitate angle-independent nonreciprocity during transmission and reception by imposing different phase gradients during up-conversion and down-conversion processes, and by preventing generation of certain propagative harmonics due to total internal reflection.

3. The reflectarray antenna of claim 1, wherein the nonlinear conversion and the phase-delay mechanism facilitate full control of shape and direction of a generated beam during the up-conversion process by imposing a configurable phase gradient.

4. The reflectarray antenna of claim 1, wherein the nonlinear conversion and the phase-delay mechanism facilitate transmitting a signal in one direction and receiving a signal from another direction.

5. The reflectarray antenna of claim 1, wherein the modulation frequency $f_m$ for the time-modulated unit-cells is more than one order of magnitude smaller than the operation frequency $f_0$.

6. The reflectarray antenna of claim 1, wherein the phase-delay mechanism controls the time-modulated capacitor in each of the time-modulated unit-cells by using a time-varying harmonic signal having frequency $\omega_m=2\pi f_m$ and phase $\varphi_m$.

7. The reflectarray antenna of claim 6, wherein a capacitance value of the time-modulated capacitor varies with time according to the function $C_p(t)=C_0[1+\Delta_m \cos(\omega_m t+\varphi_m)]$, wherein $C_0$ is an average capacitance value and $\Delta_m$ is a modulation index $0<\Delta_m<1$.

8. The reflectarray antenna of claim 1, wherein each of the time-modulated unit-cells further comprises:

a patch antenna located on a top substrate, which acts as an interface element with free space;

a plurality of slots located on a bottom substrate; and a short-circuited substrate-integrated waveguide (SIW), which hosts a varactor in a shunt configuration, wherein the varactor is located approximately $\lambda/4$ away from a short-circuit in the SIW thereby implementing a tunable resonator, wherein during operation of the reflectarray antenna, incoming power from the patch antenna is coupled through the plurality of slots to the short-circuited SIW.

9. The reflectarray antenna of claim 1, further comprising the feeder, which radiates the wave into free space at the frequency $f_0$.

10. A method for operating a reflectarray antenna, comprising:

receiving an electromagnetic wave, which was radiated by a feeder into free space at an operation frequency $f_0$; and using the reflectarray antenna to reflect the electromagnetic wave, wherein the reflectarray antenna comprises a time-modulated metasurface, which is configured to act as a planar reflector for the electromagnetic wave;

wherein while reflecting the electromagnetic wave, the time-modulated metasurface uses time-modulated unit-cells to provide a nonlinear conversion between $f_0$ and another desired frequency $f_d$, and uses a phase-delay mechanism to adjust a phase applied to a modulation frequency $f_m$, that modulates each unit-cell; and wherein each of the time-modulated unit-cells comprises a resonator with an incorporated time-modulated capacitor.

11. The method of claim 10, wherein the nonlinear conversion and the phase-delay mechanism facilitate angle-independent nonreciprocity in transmission and reception by imposing different phase gradients during up-conversion and down-conversion processes, and by preventing generation of certain propagative harmonics due to total internal reflection.

12. The method of claim 10, wherein the nonlinear conversion and the phase-delay mechanism facilitate full control of shape and direction of a generated beam during the up-conversion process by imposing a configurable phase gradient.

13. The method of claim 10, wherein the nonlinear conversion and the phase-delay mechanism facilitate transmitting a signal in one direction and receiving a signal from another direction.

14. The method of claim 10, wherein the modulation frequency $f_m$ for the time-modulated unit-cells is more than one order of magnitude smaller than the operation frequency $f_0$.

15. The method of claim 10, wherein the phase-delay mechanism controls the time-modulated capacitor in each of the time-modulated unit-cells by using a time-varying harmonic signal having frequency $\omega_m=2\pi f_m$ and phase $\varphi_m$.

16. The method of claim 15, wherein a capacitance value of the time-modulated capacitor varies with time as $C_p(t)=C_0[1+\Delta_m \cos(\omega_m t+\varphi_m)]$, wherein $C_0$ is an average capacitance value and $\Delta_m$ is a modulation index $0<\Delta_m<1$.

17. A system that includes a reflectarray antenna, comprising:

a housing;

a computer system mounted to the housing; and the reflectarray antenna mounted to the housing, which comprises, a time-modulated metasurface configured to act as a planar reflector for an electromagnetic wave, which is radiated by a feeder into free space at an operation frequency $f_0$, wherein:

the time-modulated metasurface includes time-modulated unit-cells that provide a nonlinear conversion between $f_0$ and another desired frequency $f_d$, and each of the time-modulated unit-cells comprises a resonator with an incorporated time-modulated capacitor; and a phase-delay mechanism that adjusts a phase delay by acting on a phase applied to a modulation frequency $f_m$, that modulates each unit-cell.

18. The system of claim 17, wherein the nonlinear conversion and the phase-delay mechanism facilitate angle-independent nonreciprocity by imposing different phase gradients during up-conversion and down-conversion processes, and by preventing generation of certain propagative harmonics due to total internal reflection.

19. The system of claim 17, wherein the nonlinear conversion and the phase-delay mechanism facilitate full control of shape and direction of a generated beam during the up-conversion process by imposing a configurable phase gradient.

20. The system of claim 17, wherein the nonlinear conversion and the phase-delay mechanism facilitate transmitting a signal in one direction and receiving a signal from another direction.

21. The system of claim 17, wherein the modulation frequency $f_m$ for the time-modulated unit-cells is more than one order of magnitude smaller than the operation frequency $f_0$.

22. The system of claim 17, wherein the phase-delay mechanism controls the time-modulated capacitor in each of the time-modulated unit-cells by using a time-varying harmonic signal having frequency $\omega_m=2\pi f_m$ and phase $\varphi_m$.

23. The system of claim 22, wherein a capacitance value of the time-modulated capacitor varies with time as $C_p(t)=C_0[1+\Delta_m \cos(\omega_m t+\varphi_m)]$, wherein $C_0$ is an average capacitance value and $\Delta_m$ is a modulation index $0<\Delta_m<1$.

24. The system of claim 22, wherein each of the time-modulated unit-cells comprises:

a patch antenna located on a top substrate, which acts as an interface element with free space;

a plurality of slots located on a bottom substrate; and a short-circuited substrate-integrated waveguide (SIW), which hosts a varactor in a shunt configuration, wherein the varactor is located approximately $\lambda/4$ away from a short-circuit in the SIW thereby implementing a tunable resonator, wherein during operation of the reflectarray antenna, incoming power from the patch antenna is coupled through the plurality of slots to the short-circuited SIW.

25. The system of claim 17, wherein the system comprises a satellite.

26. The system of claim 17, wherein the system comprises a radar system.

27. A reflectarray antenna, comprising:

a time-modulated metasurface configured to act as a planar reflector for an electromagnetic wave, which is radiated by a feeder into free space at an operation frequency $f_0$, wherein the time-modulated metasurface includes time-modulated unit-cells that provide a nonlinear conversion between $f_0$ and another desired frequency $f_d$; and a phase-delay mechanism, which adjusts a phase delay by acting on a phase applied to a modulation frequency $f_m$, that modulates each unit-cell;

wherein the nonlinear conversion and the phase-delay mechanism facilitate angle-independent nonreciprocity during transmission and reception by imposing different phase gradients during up-conversion and down-conversion processes, and by preventing generation of certain propagative harmonics due to total internal reflection.

28. The reflectarray antenna of claim 27, wherein the nonlinear conversion and the phase-delay mechanism further facilitate full control of shape and direction of a generated beam during the up-conversion process by imposing a configurable phase gradient.

29. The reflectarray antenna of claim 27, wherein the nonlinear conversion and the phase-delay mechanism further facilitate transmitting a signal in one direction and receiving a signal from another direction.

30. The reflectarray antenna of claim 27, wherein the modulation frequency $f_m$, for the time-modulated unit-cells is more than one order of magnitude smaller than the operation frequency $f_0$.

31. The reflectarray antenna of claim 27, wherein each of the time-modulated unit-cells comprises a resonator with an incorporated time-modulated capacitor.

32. The reflectarray antenna of claim 31, wherein the phase-delay mechanism controls the time-modulated capacitor in each of the time-modulated unit-cells by using a time-varying harmonic signal having frequency $\omega_m=2\pi f_m$ and phase $\varphi_m$.

33. The reflectarray antenna of claim 32, wherein a capacitance value of the time-modulated capacitor varies with time according to the function $C_p(t)=C_0[1+\Delta_m \cos$ $(\omega_m t+\varphi_m)]$, wherein $C_0$ is an average capacitance value and $\Delta_m$ is a modulation index $0<\Delta_m<1$.

34. The reflectarray antenna of claim 31, wherein each of the time-modulated unit-cells further comprises:

a patch antenna located on a top substrate, which acts as an interface element with free space;

a plurality of slots located on a bottom substrate; and a short-circuited substrate-integrated waveguide (SIW), which hosts a varactor in a shunt configuration, wherein the varactor is located approximately $\lambda/4$ away from a short-circuit in the SIW thereby implementing a tunable resonator, wherein during operation of the reflectarray antenna, incoming power from the patch antenna is coupled through the plurality of slots to the short-circuited SIW.

35. The reflectarray antenna of claim 27, further comprising the feeder, which radiates the wave into free space at the frequency $f_0$.

36. A method for operating a reflectarray antenna, comprising:

receiving an electromagnetic wave, which was radiated by a feeder into free space at an operation frequency $f_0$; and using the reflectarray antenna to reflect the electromagnetic wave, wherein the reflectarray antenna comprises a time-modulated metasurface, which is configured to act as a planar reflector for the electromagnetic wave;

wherein while reflecting the electromagnetic wave, the time-modulated metasurface uses time-modulated unit-cells to provide a nonlinear conversion between $f_0$ and another desired frequency $f_d$, and uses a phase-delay mechanism to adjust a phase applied to a modulation frequency $f_m$, that modulates each unit-cell; and wherein the nonlinear conversion and the phase-delay mechanism facilitate angle-independent nonreciprocity in transmission and reception by imposing different phase gradients during up-conversion and down-conversion processes, and by preventing generation of certain propagative harmonics due to total internal reflection.

37. The method of claim 36, wherein the nonlinear conversion and the phase-delay mechanism further facilitate full control of shape and direction of a generated beam during the up-conversion process by imposing a configurable phase gradient.

38. The method of claim 36, wherein the nonlinear conversion and the phase-delay mechanism further facilitate transmitting a signal in one direction and receiving a signal from another direction.

39. The method of claim 36, wherein the modulation frequency $f_m$ for the time-modulated unit-cells is more than one order of magnitude smaller than the operation frequency $f_0$.

40. The method of claim 36, wherein each of the time-modulated unit-cells comprises a resonator with an incorporated time-modulated capacitor.

41. The method of claim 40, wherein the phase-delay mechanism controls the time-modulated capacitor in each of the time-modulated unit-cells by using a time-varying harmonic signal having frequency $\omega_m=2\pi f_m$ and phase $\varphi_m$.

42. The method of claim 41, wherein a capacitance value of the time-modulated capacitor varies with time as $C_p(t)=C_0[1+\Delta_m \cos(\omega_m t+\varphi_m)]$, wherein $C_0$ is an average capacitance value and $\Delta_m$ is a modulation index $0<\Delta_m<1$.

43. A system that includes a reflectarray antenna, comprising:

a housing;

a computer system mounted to the housing; and the reflectarray antenna mounted to the housing, the reflectarray antenna comprising:

a time-modulated metasurface configured to act as a planar reflector for an electromagnetic wave, which is radiated by a feeder into free space at an operation frequency $f_0$, wherein the time-modulated metasurface includes time-modulated unit-cells that provide a nonlinear conversion between $f_0$ and another desired frequency $f_d$, and a phase-delay mechanism that adjusts a phase delay by acting on a phase applied to a modulation frequency $f_m$ that modulates each unit-cell;

wherein the nonlinear conversion and the phase-delay mechanism facilitate angle-independent nonreciprocity by imposing different phase gradients during up-conversion and down-conversion processes, and by preventing generation of certain propagative harmonics due to total internal reflection.

44. The system of claim 43, wherein the nonlinear conversion and the phase-delay mechanism further facilitate full control of shape and direction of a generated beam during the up-conversion process by imposing a configurable phase gradient.

45. The system of claim 43, wherein the nonlinear conversion and the phase-delay mechanism further facilitate transmitting a signal in one direction and receiving a signal from another direction.

46. The system of claim 43, wherein the modulation frequency $f_m$, for the time-modulated unit-cells is more than one order of magnitude smaller than the operation frequency $f_0$.

47. The system of claim 43, wherein each of the time-modulated unit-cells comprises a resonator with an incorporated time-modulated capacitor.

48. The system of claim 47, wherein the phase-delay mechanism controls the time-modulated capacitor in each of the time-modulated unit-cells by using a time-varying harmonic signal having frequency $\omega_m=2\pi f_m$ and phase $\varphi_m$.

49. The system of claim 47, wherein a capacitance value of the time-modulated capacitor varies with time as $C_p(t)=C_0[1+\Delta_m \cos(\omega_m t+\varphi_m)]$, wherein $C_0$ is an average capacitance value and $\Delta_m$ is a modulation index $0<\Delta_m<1$.

50. The system of claim 47, wherein each of the time-modulated unit-cells comprises:

a patch antenna located on a top substrate, which acts as an interface element with free space;

a plurality of slots located on a bottom substrate; and a short-circuited substrate-integrated waveguide (SIW), which hosts a varactor in a shunt configuration, wherein the varactor is located approximately $\lambda/4$ away from a short-circuit in the SIW thereby implementing a tunable resonator, wherein during operation of the reflectarray antenna, incoming power from the patch antenna is coupled through the plurality of slots to the short-circuited SIW.

51. The system of claim 43, wherein the system comprises a satellite.

52. The system of claim 43, wherein the system comprises a radar system.

* * * * *